United States Patent [19]

Waris et al.

[11] 4,432,835

[45] Feb. 21, 1984

[54] METHOD AND AN APPARATUS FOR THE FEEDING OF A FIBRE SUSPENSION ONTO THE WIRE OF A WEB FORMER

[75] Inventors: Tapio Waris, Kyminlinna; Sven-Eric E. Lindroos, Karhula, both of Finland

[73] Assignee: A. Ahlstrom Osakeyhtio, Noormarkku, Finland

[21] Appl. No.: 351,156

[22] Filed: Feb. 22, 1982

[30] Foreign Application Priority Data

Apr. 7, 1981 [FI] Finland ..... 811065

[51] Int. Cl.[3] ..... D21F 1/06

[52] U.S. Cl. ..... 162/212; 162/336; 162/340; 162/343

[58] Field of Search ..... 162/212, 340, 343, 337, 162/336, 216, 341, 339

[56] References Cited

U.S. PATENT DOCUMENTS 3,216,892 11/1965 Wahlstrom et al. ..... 162/343
3,923,593 12/1975 Verseput ..... 162/343
4,294,657 10/1981 Saito et al. ..... 162/337

*Primary Examiner*—Steve Alvo
*Attorney, Agent, or Firm*—Bucknam and Archer

[57] ABSTRACT

A method and apparatus for feeding a fibre suspension onto the wire of a web former through a guiding device consisting of a plurality of guiding channels through which the fibre suspension flows parallelly and which are connected to a slice chamber leading to a slice and extending across the wire of the web former. A means for separating the dilute outer part of the jet of stock flowing in from every single flow channel is disposed downstream of the guiding device. The outer portion is deflected from the direction of flow of the thicker and more homogeneous core part and the latter is allowed to proceed up to the lip substantially maintaining its direction. Thus, a situation is reached, whereby considerably less local consistency variations occur in the lip flow across the head box. Preferably, this means is formed by a plate in which there are openings disposed coaxially with regard to the manifold tubes so that the diameter of the openings of the plate is smaller than that of the openings of the tubes.

9 Claims, 7 Drawing Figures

(A-A)

(B-B')

(C-C)

METHOD AND AN APPARATUS FOR THE FEEDING OF A FIBRE SUSPENSION ONTO THE WIRE OF A WEB FORMER

The present invention relates to a method and an apparatus for feeding a fibre suspension onto a wire of a web former through a guiding device consisting of a plurality of guiding channels through which the fibre suspension flows parallelly and which are connected to a slice chamber leading to a slice and extending across the wire of a web former.

It is an object of the present invention to provide a method and an apparatus for manufacturing paper of a higher quality than it has been possible so far by apparatus of this type.

It is known that where a fibre suspension flows through a pipe, fibres and water are separated from each other so that the consistency is highest in the center of a pipe and the consistency decreases towards the walls of the pipe. The nature and intensity of this phenomenon depend on several factors, e.g. as the consistency increases, at some stage a plug flow is reached, whereby the stock flows as an integral plug with an homogeneous consistency, and water or dilute pulp fills the space between it and the wall of the pipe.

The most important factors affecting this phenomenon are the fibre quality, pipe diameter, flow velocity and fibre consistency.

In the research carried out it has been found that separation clearly takes place even in an extremely short pipe.

In the following there are some examples of the results obtained by means of the testing apparatus illustrated in FIG. 1.

The following definitions are used:

Q=Flow quantity

C=Consistency

V=Flow velocity

| Example 1: D = 53 mm, d = 48,3 mm, $Q_2$ = 20 l/min | | |
|---|---|---|
| $V_1$ m/s | $Q_2/Q_3$ | $C_2/C_3$ |
| 2,0 | 0,08 | 0,54 |
| 1,67 | 0,10 | 0,59 |
| 1,3 | 0,13 | 0,60 |
| 0,9 | 0,20 | 0,75 |
| 0,72 | 0,27 | 0,88 |

| Example 2: D = 53 mm, d = 48,3 mm, $Q_2$ = 30 l/min | | |
|---|---|---|
| $V_1$ m/s | $Q_2/Q_3$ | $C_2/C_3$ |
| 2,1 | 0,1 | 0,60 |
| 1,74 | 0,12 | 0,66 |
| 1,36 | 0,20 | 0,67 |
| 0,98 | 0,30 | 0,83 |
| 0,80 | 0,40 | 1,0 |

| Example 3: D = 14 mm, d = 12 mm, $Q_2$ = 3 l/min | | |
|---|---|---|
| $V_1$ m/s | $Q_2/Q_3$ | $C_2/C_3$ |
| 1,9 | 0,25 | 0,36 |

| Example 4: D = 14 mm, d = 12 mm, $Q_2$ = 6 l/min | | |
|---|---|---|
| $V_1$/m/s/ | $Q_2/Q_3$ | $C_2/C_3$ |
| 7,7 | 0,11 | 0,49 |

The separation of pulp and water is a disadvantageous phenomenon in a head box flow. In flow channels, into which a head box is often divided, in perforated rolls and generally in all elements restricting or guiding the flow, water is separated against these surfaces. This in turn results in wakes which proceed as far as to the lip and farther to the wire and thus cause streakiness in the finished product. It usually depends greatly on the location of the components of the wire part with regard to each other and to the head box, to which extent it is possible to stir the flow patterns and to eliminate the consistency variations.

By constructing the slice chamber of the head box so that after a fixed manifold tube system or after some other guiding device consisting of parallel guiding channels there are means for separating the dilute outer portion of the stock flowing from each single flow channel and deflecting it from the direction of flow of the thicker and more homogeneous core part and by letting the latter proceed up to the lip substantially maintaining its direction, a situation is reached, whereby considerably less local consistency variations occur in the lip flow across the head box compared to known head boxes equipped with a guiding device of this kind. Preferably, these means are formed by a plate in which there are openings disposed coaxially with regard to the manifold tubes (or corresponding) so that the diameter of the openings of the plate is smaller or as large as that of the openings of the tubes.

The volume of the separated dilute outer portion stock is preferably 5 to 30% of the coming stock. It is relatively dilute, the consistency being 30 to 70% of the incoming stock.

The dilute stock can be conducted to various places, either back to the feeding pump or back to some part of the head box prior to the tube system. One possible way is to build an inner recirculation for the return flow: this kind of a method can be applied to the so called hydraulic head box in which the static pressure of the slice chamber is higher than that of the middle chamber.

The dilute stock can be conducted to the slice chamber, whereby the feeding is carried out through a continuous slit which extends across the head box and by means of which the uniformity of the consistency in the cross feeding direction is secured. There can be one or more slits.

The invention is described more in detail with reference to the accompanying drawings in which FIG. 1 shows a cross-sectional view of the testing apparatus by means of which the method according to the present invention has been studied;

Figure 1:
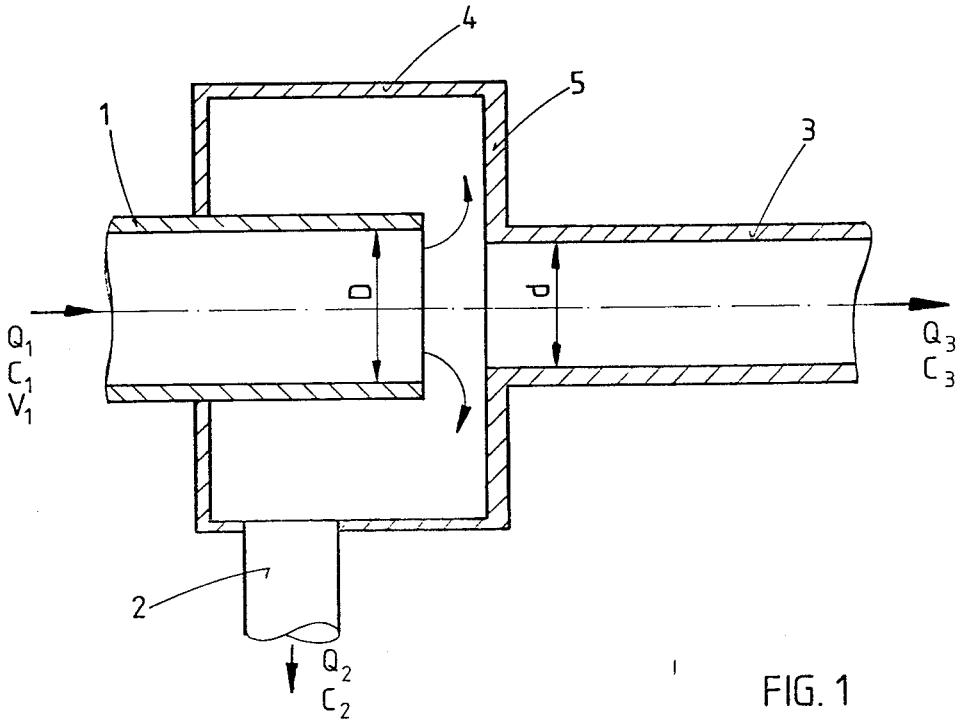

In FIG. 1, Q, C and V refer to the flow quantity, consistency and flow velocity of the fibre suspension fed into a pipe 1. The outer part of the jet of stock close to the wall of the pipe flowing out of pipe 1 is separated from the flow direction of the core part by deflecting the outer part from the direction of the core part as it hits a wall 5 of a chamber 4 while the core part flows, maintaining its direction, to a pipe 3 having a smaller diameter. The flow quantity and consistency of the fibre suspension flowing through pipe 3 are $Q_3$ and $C_3$. The core part which is separated is discharged from the chamber through pipe 3. In pipe 2, the flow quantity and consistency are $Q_2$ and $C_2$.

Figure 2:
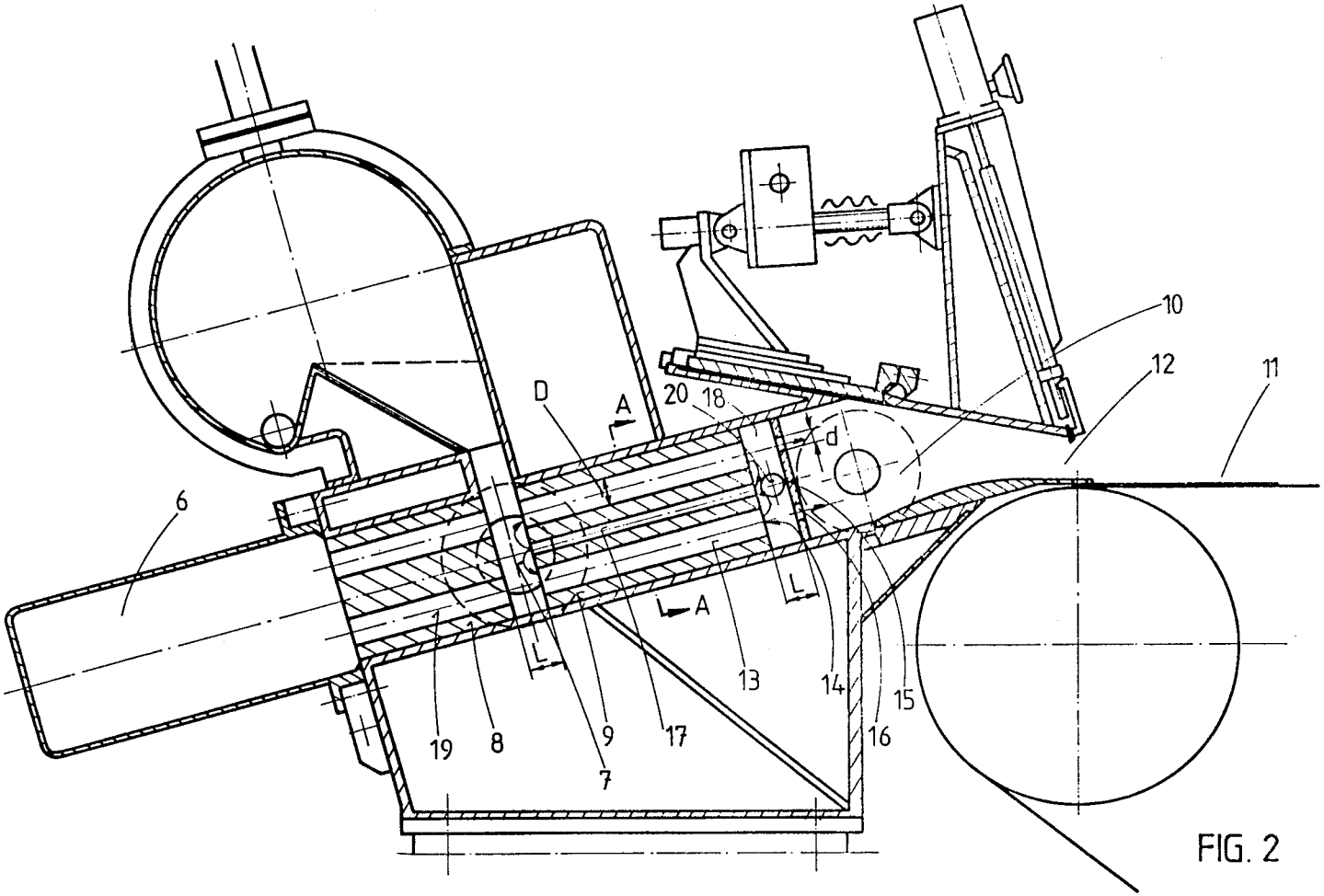
FIG. 2 shows a cross-sectional view in the machine direction of a head box applying the method according to the present invention.

In FIG. 2, numeral 6 is a header of a paper making machine head box from which the pulp stock flows crosswise to channels 8 which lead from the header in the machine direction to an equalizing chamber 7. Downstream of the equalizing chamber there is a guiding device 9 which conducts the pulp stock to a slice chamber 10 from which the pulp stock flows out onto the forming wire 11 through an adjustable slice 12. The guiding device consists of a plurality of parallel guiding channels 13 having a circular cross-section the diameter of which is D.

A thin blocking plate 15 is disposed in the slice chamber at a distance L from the discharge openings 14 of the guiding channels. In the plate there are circular openings 16 having a diameter d disposed coaxially with regard to the guiding channels.

The diameter ratio D/d is preferably from 2 to 1 and the distance L is as large or smaller than D.

The guiding device is equipped with return channels 17 which connect the space 18 between the discharge openings and the blocking plate to the equalizing chamber and which are disposed adjacently to the guiding channels.

Figure 3:
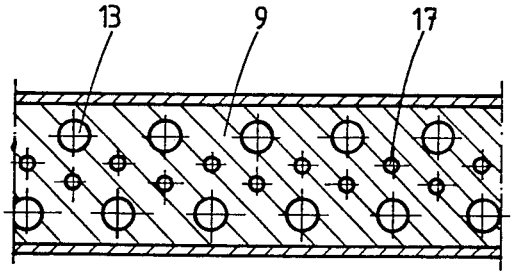
FIG. 3 shows a sectional view taken along line A—A of FIG. 2.

The apparatus illustrated in FIGS. 2 and 3 operates in the following way. Due to the blocking plate 15 and the hole 16 in it, a dilute outer part is separated from the jets of stock flowing out of every single guiding channel 13, while the thicker core part continues to move towards the slice 12. The separated, more dilute pulp fraction is discharged from the space 18 between the discharge openings and the blocking plate to the equalizing chamber 7 through return channels 17. This can be done, because due to the special structure of the head box, the pressure in the equalizing chamber is lower than in the space 18. Channels 19 leading to the equalizing chamber and the guiding channels 13 leaving from them are disposed so in the head box that while the jets of stock flow to the guiding channels, they create an injector effect which lowers the pressure in the equalizing chamber.

Optionally, it is possible to conduct the pulp from the space between the discharge openings and the blocking plate through an opening 20 in the plate to some other place.

Figure 4:
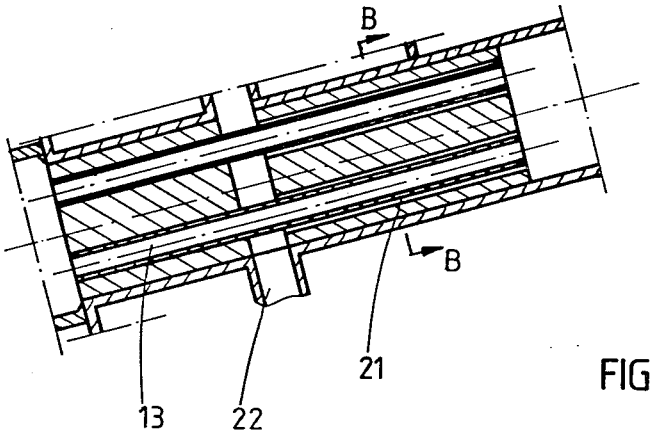
FIG. 4 shows a sectional view of another embodiment of the invention.
Figure 5:
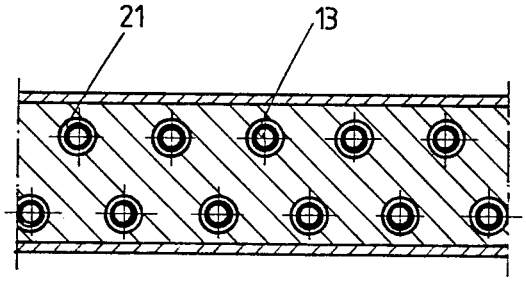
FIG. 5 shows a sectional view taken along line B—B of FIG. 4.

In the alternative embodiment illustrated in FIGS. 4 and 5, return channels 21 are disposed coaxially with regard to the guiding channels 13. The return channels communicate with a discharge pipe 22. There is no blocking plate, but the outer portion of the jets of stock flowing out of the guiding channels is deflected due to a difference in pressure between the guiding channels and the return channels. The return channels can be connected to the equalizing chamber, if the difference in pressure between the equalizing chamber and the slice chamber is big enough.

Figure 6:
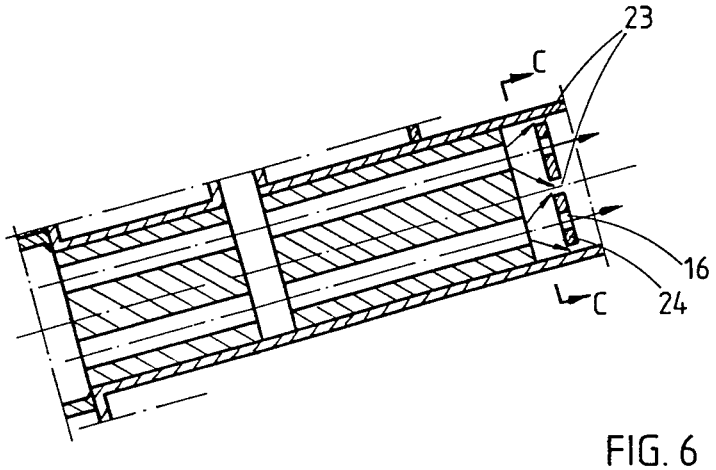
FIG. 6 shows a sectional view of a third embodiment of the invention.
Figure 7:
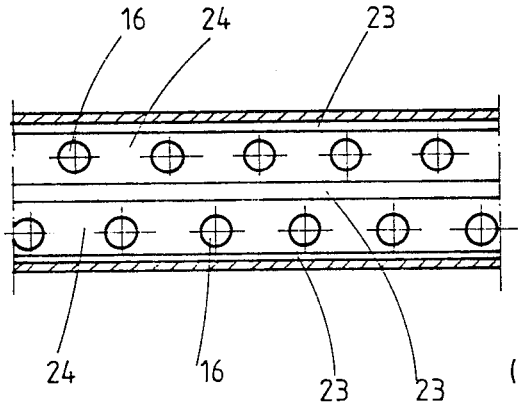
FIG. 7 shows a sectional view taken along line C—C of FIG. 6.

In the alternative embodiment illustrated in FIGS. 6 and 7, there are slits 23 disposed downstream of the discharge openings of the guiding device and extending across the slice chamber, through which slits the separated outer parts of the stock jets are caused to flow so that they and the core parts which have penetrated through the openings 16 of the blocking plates 24 form superimposed layers in the slice chamber and flow together through the slice. There can be one or more slits.

We claim:

1. A method of feeding a fibre suspension onto the wire of a web former, which comprises:

(a) letting the fibre suspension flow through a guiding device consisting of a plurality of parallel guiding channels, said guiding channels having discharge openings of circular cross section, said guiding channels being connected to a slice chamber which is coaxial with said guiding device and downstream thereto and which leads to a slice and extends across the wire of the web former, the distance between said guiding channels and said slice chamber being not greater than the diameter of said discharge openings;

(b) separating the outer parts and the core parts of the jets of stock of said fiber suspension flowing out of said guiding channels from one another in said slice chamber by deflecting the outer parts from the flow direction of the core parts; and (c) causing the pressure in the second space between said discharge openings of the guiding channels and the slice chamber to rise above the pressure in the first space upstream of said guiding device, whereby said outer parts of the jets of stock are discharged from said second space and returned to said first space.

2. The method according to claim 1, wherein the separated outer parts and core parts of the jets of stock are caused to flow towards the slice in the slice chamber as superimposed layers, prior to said step (c).

3. An apparatus for feeding a fibre suspension onto a wire of a web former which comprises first means for introducing the fiber suspension to a guiding device, said guiding device comprising a plurality of parallel guiding channels having first discharge openings of circular cross section, a slice chamber connected to said guiding device and coaxial thereto, said slice chamber leading to a slice which extends across the wire, the distance between said slice chamber and said discharge openings being not greater than the diameter of said first discharge openings, second means coaxial with said guiding channels and arranged downstream thereto for deflecting the outer parts of the jets of stock of said fiber suspension from the flow direction of the core parts of the jets of stock and for returning said outer parts to a point upstream of said guiding device.

4. The apparatus according to claim 3, wherein said second means comprise a blocking plate which has second openings disposed coaxially with respect to each of said guiding channels of the guiding device, said second openings being not greater than the corresponding first discharge opening of each of said guiding channels.

5. The apparatus according to claim 4, wherein the second openings in the blocking plate are of circular cross section.

6. The apparatus according to claim 5, wherein the ratio D/d of the diameter D of the first discharge openings of the guiding channels and the diameter d of the second openings in the blocking plate is from 2 to 1.

7. The apparatus according to claim 5, wherein the thickness of the blocking plate is smaller than the diameter of the second openings of the plate.

8. The apparatus according to claim 3, which is provided, downstream of the first discharge openings of the guiding device, with at least one continuous slit adjacent to the second openings of the blocking plate.

9. The apparatus according to claim 3, wherein said second means for deflecting the outer parts of the jets of the stock comprise return channels arranged coaxially with respect to the guiding channels adjacent thereto, said return channels communicating with a discharge pipe upstream of the guiding channels.

* * * * *